US010899576B2

(12) United States Patent
Masaki

(10) Patent No.: US 10,899,576 B2
(45) Date of Patent: Jan. 26, 2021

(54) CORD REEL APPARATUS

(71) Applicant: Panasonic Intellectual Property Management Co., Ltd., Osaka (JP)

(72) Inventor: Ryota Masaki, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 39 days.

(21) Appl. No.: 16/449,772

(22) Filed: Jun. 24, 2019

(65) Prior Publication Data

US 2020/0399093 A1 Dec. 24, 2020

(51) Int. Cl.
*B65H 75/44* (2006.01)

(52) U.S. Cl.
CPC ..... *B65H 75/4428* (2013.01); *B65H 75/4471* (2013.01)

(58) Field of Classification Search
CPC ..... B65H 75/28; B65H 75/40; B65H 75/406; B65H 75/48; B65H 75/4428; B65H 75/4471; B65H 75/4473
See application file for complete search history.

(56) References Cited

U.S. PATENT DOCUMENTS 7,523,883 B2 * 4/2009 Cheng ..... B65H 75/4434 242/378
7,784,727 B1 * 8/2010 Liao ..... B65H 75/4434 242/378.1
8,136,751 B2 * 3/2012 Chen ..... B65H 75/4434 242/378.1
8,702,025 B2 * 4/2014 Kish ..... B65H 75/4434 242/378.1
2006/0011763 A1 * 1/2006 Kuo ..... H02G 11/02 242/378.1
2014/0151486 A1 6/2014 Chen

FOREIGN PATENT DOCUMENTS

| | | |
|---|---|---|
| JP | 59-100770 | 7/1984 |
| JP | 02-018051 | 5/1990 |
| JP | 2003-292252 | 10/2003 |
| JP | 3186491 | 10/2013 |
| JP | 2015-084696 | 5/2015 |

* cited by examiner

*Primary Examiner* — William A. Rivera
(74) *Attorney, Agent, or Firm* — Wenderoth, Lind & Ponack, L.L.P.

(57) ABSTRACT

A cord reel apparatus includes a circular plate configured to rotate in response to pulling out or rewinding of a cord, a guide groove on the circular plate, a sensor member having a first protrusion which is slidable in the guide groove, a top plate facing the circular plate with the sensor member sandwiched therebetween, a second protrusion provided on the sensor member and projecting in a direction toward the circular plate, and a first pressing portion provided on the sensor member and disposed in a direction toward the top plate. When the first protrusion is closest to a bottom surface of the guide groove, the second protrusion is not in contact with the circular plate. When the first protrusion rides on a wall surface of the guide groove, the first pressing portion is in contact with the top plate, so that the second protrusion contacts the circular plate.

4 Claims, 13 Drawing Sheets

CORD REEL APPARATUS

BACKGROUND OF THE INVENTION

1. Field of the Invention

The present disclosure relates to a cord reel apparatus.

2. Description of the Related Art

JP-A-2003-292252 discloses a cord reel including a case which has a guide groove therein, a reel which is provided inside the case and is capable of winding a cord along a surface on one side of a rotatable board with a substantially disc shape, a biasing member for biasing the reel in a direction of winding the cord inside the case, and a stop lever which is provided slidably with respect to the reel to temporarily lock the reel in a locking groove which is provided inside the case as a part of the guide groove. The cord reel is used by being mounted in various electric appliances, and the case is formed by combining a main body portion and a lid portion which are defined by dividing the case into two parts in a vertical direction. An inclined surface which is inclined in a radial direction of the lid portion is formed on an end surface of the lid portion. The inclined surface is formed such that a distance between an end surface of the main body portion and the end surface of the lid portion is smaller at a periphery than at a center of the end surface.

SUMMARY OF THE INVENTION

The present disclosure has been proposed in view of the circumstances in the related art, and an object thereof is to provide a cord reel apparatus which reduces the increase in material cost and the increase in product size, and restricts separation of a sensor member without impairing feeling of operation.

The present disclosure provides a cord reel apparatus including: a circular plate configured to rotate in response to pulling out or rewinding of a cord, a guide groove provided as a recess on the circular plate, a sensor member having a first protrusion which is slidable in the guide groove, a top plate facing the circular plate with the sensor member sandwiched therebetween, a second protrusion provided on the sensor member and projecting in a direction toward the circular plate, and a first pressing portion provided on the sensor member and disposed in a direction toward the top plate. When the first protrusion is closest to a bottom surface of the guide groove, the second protrusion is not in contact with the circular plate, and when the first protrusion rides on a wall surface of the guide groove, the first pressing portion is in contact with the top plate, so that the second protrusion is in contact with the circular plate.

According to the present disclosure, in the cord reel apparatus, the increase in material cost and the increase in product size can be reduced, and the separation of the sensor member can be restricted without impairing the feeling of operation.

DESCRIPTION OF THE PREFERRED EMBODIMENTS

[Process of Obtaining One Embodiment of Present Disclosure]

In the related art, the cord reel apparatus for pulling out and winding a cord includes a case which has a guide groove therein, a reel which is capable of winding the cord, and a stop lever for temporarily locking the reel in a locking groove provided as a part of the guide groove. However, when a user pulls the cord violently or the like, the reel may rotate at a high speed, a protrusion of the stop lever may be pushed to the locking groove, and the protrusion may be separated from the guide groove. In order to prevent the above problem, it is conceivable to make the stop lever high in strength as a measure against deformation of the stop lever. However, when the strength of the stop lever is made high, an expensive material is used, and thus the material cost may be increased. A production size may be increased due to reinforcement. Further, when the strength of the stop lever is high, a spring constant may be increased, and the feeling of operation of the reel may be deteriorated.

Hereinafter, with reference to the drawings, an embodiment specifically disclosing a cord reel apparatus according to the present disclosure will be described in detail. However, unnecessarily detailed descriptions may be omitted. For example, a detailed description of a well-known matter or a repeated description of substantially the same configuration may be omitted. This is to avoid unnecessary redundancy in the following description and to facilitate understanding of those skilled in the art. It is to be understood that the accompanying drawings and the following description are provided to enable those skilled in the art to fully understand the present disclosure, and are not intended to limit the range of the claims.

[Configurations or the Like]

Hereinafter, a cord reel apparatus will be described in which an increase in material cost and an increase in product size can be reduced, and separation of a sensor member can be restricted without impairing the feeling of operation.

Figure 1:
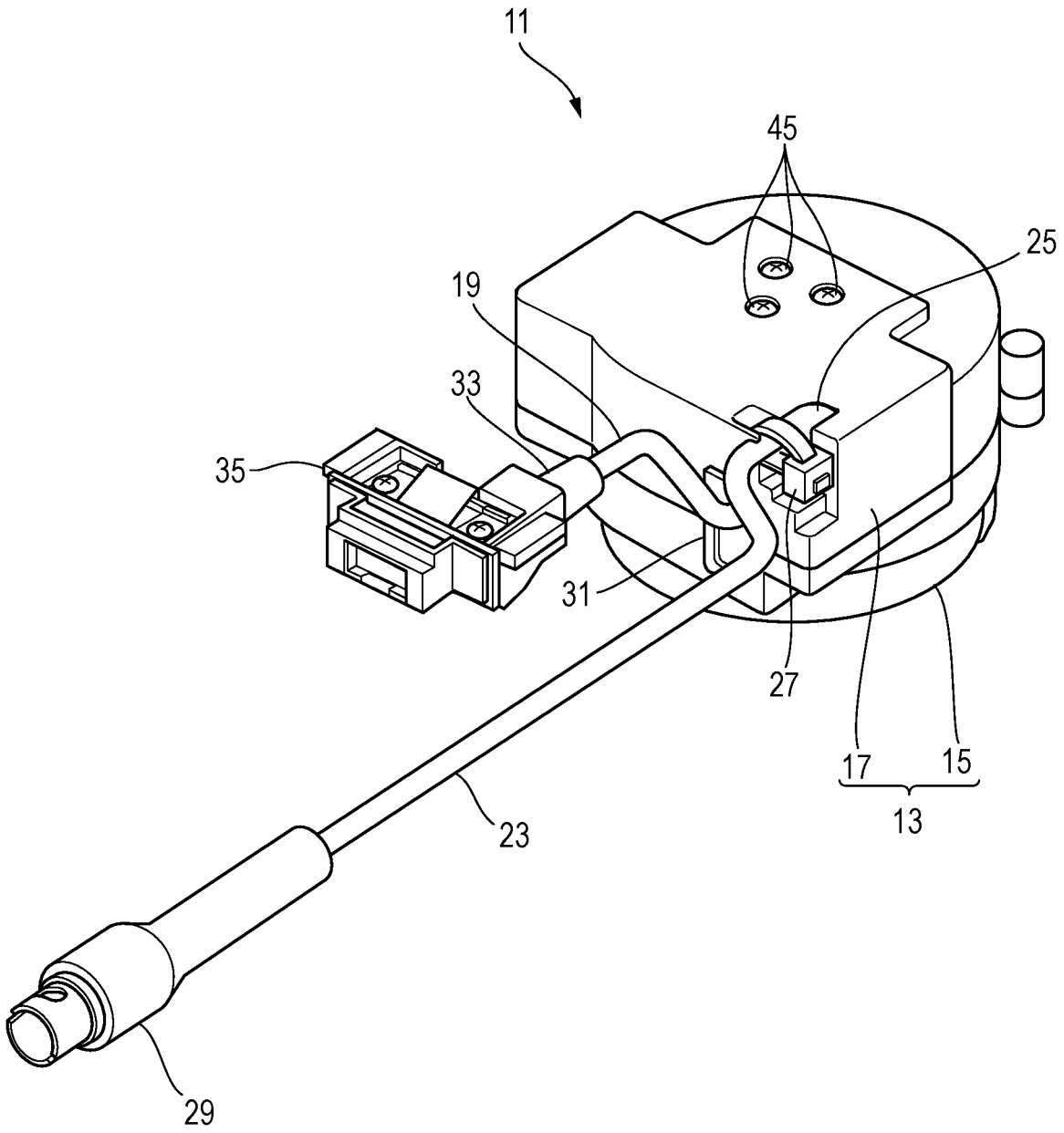
FIG. 1 is a perspective view showing an appearance of a cord reel apparatus according to a first embodiment.

FIG. 1 is a perspective view showing an appearance of a cord reel apparatus 11 according to a first embodiment. The cord reel apparatus 11 according to the first embodiment includes a housing 13. The housing 13 is accommodated, for example, in a backrest of a seat of an aircraft.

The housing 13 includes a lower case 15 and an upper case 17. A reel 21 (with reference to FIG. 3) for holding a cord 19 in a wound state is rotatably accommodated in the housing 13. A host-side connecting wire 23 is electrically connected to the cord 19 wound around the reel 21 via a sliding contact (not shown) such as a slip ring. The host-side connecting wire 23 is lead out of the housing 13 from a lead-out opening 25 opened in the upper case 17, and is fixed to the upper case 17 by a binding band 27. A host-side connecting connector 29 is attached to a lead-out tip end of the host-side connecting wire 23.

A pull-out opening frame 31 of the cord 19 is attached to the housing 13 across the lower case 15 and the upper case 17. The cord 19 can be rewound into and pulled out of the housing 13 by passing through the pull-out opening frame 31. A slave-side connecting connector 33 which can be connected to, for example, a handset or a mobile electronic device, is attached to a pull-out direction end of the cord 19. The slave-side connecting connector 33 is coupled to, for example, a mating connector 35 of the handset.

Figure 2:
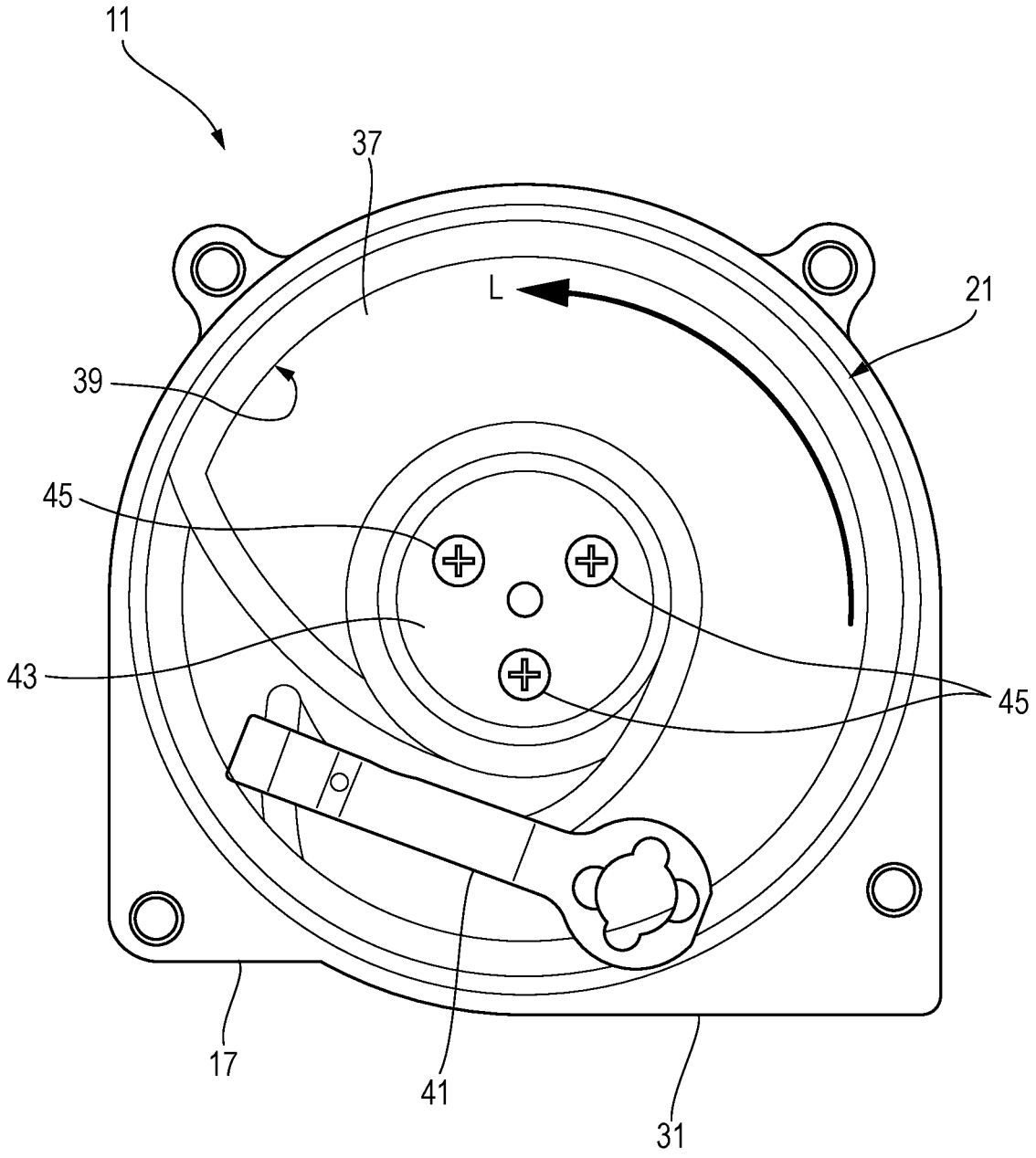
FIG. 2 is a plan view of a housing seen through an upper case of the cord reel apparatus shown in FIG. 1.

FIG. 2 is a plan view of the housing seen through the upper case 17 of the cord reel apparatus 11 shown in FIG. 1. A circular plate 37 of the reel 21 is disposed inside the upper case 17. The circular plate 37 rotates in response to the pulling out or rewinding of the cord 19. The reel 21 is biased by a spiral spring (not shown) accommodated in the lower case 15 so as to rotate in a counterclockwise direction indicated by an arrow L in FIG. 2. A guide groove 39 is formed on the circular plate 37 as a recess by digging a surface of the circular plate. An arm-shaped sensor member 41 is provided inside the housing 13.

A base end of the sensor member 41, which is on one end in a longitudinal direction, is supported by, for example, the upper case 17 rotatably around a rotation center perpendicular to the circular plate 37. A tip end of the sensor member 41 is a free end. The base end of the sensor member 41 is supported rotatably, and thus the tip end can be moved in and out of the circular plate 37.

Figure 3:
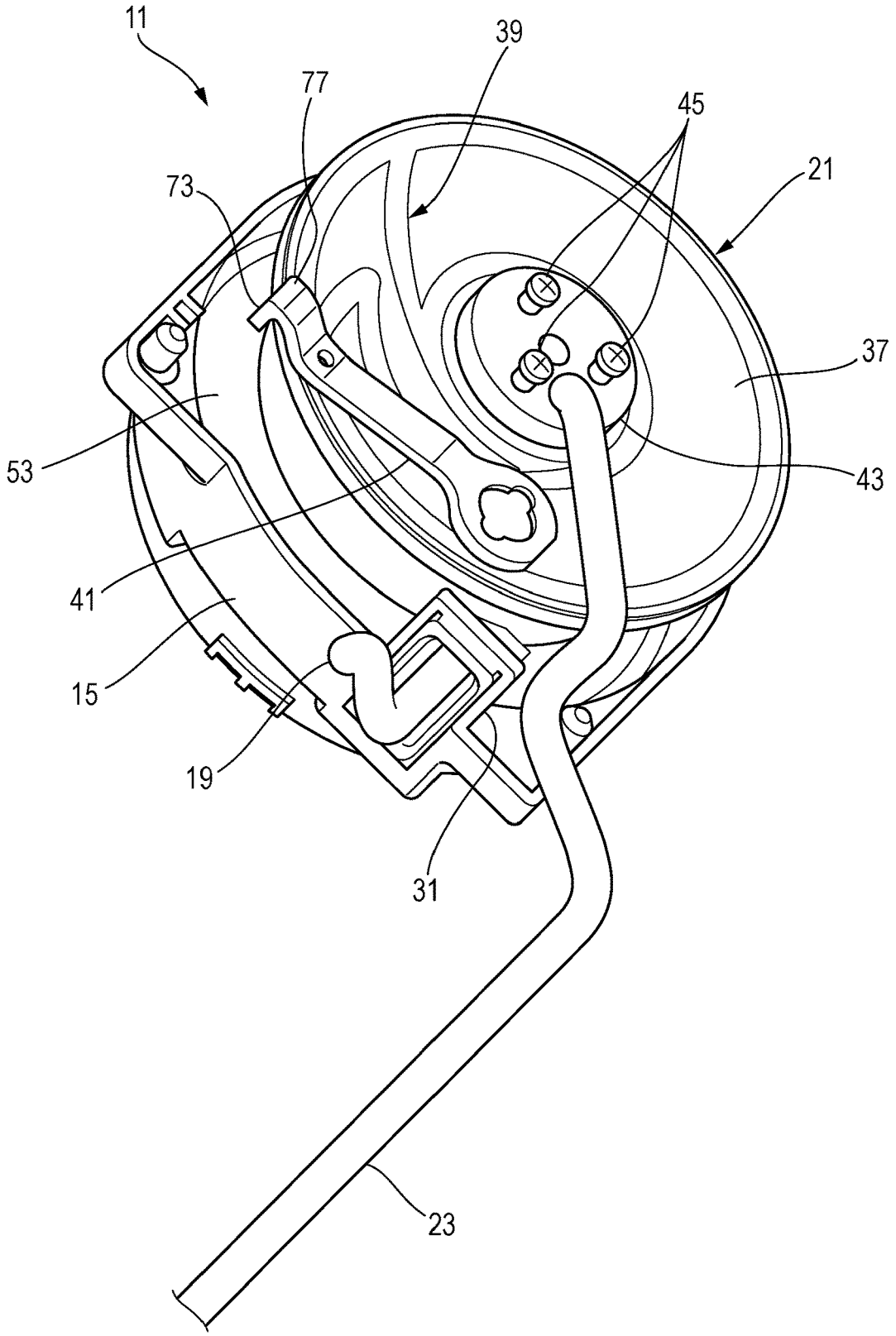
FIG. 3 is a perspective view of the cord reel apparatus with the upper case of the housing removed.

FIG. 3 is a perspective view of the cord reel apparatus 11 with the upper case 17 of the housing 13 removed. The reel 21 is held below the circular plate 37 with the cord 19 wound thereon. A non-rotatable fixing plate 43 fixed on the housing 13 is provided on a rotation center side of the reel 21. The fixing plate 43 is fixed to the upper case 17 by, for example, three fixing screws 45 provided at equal intervals in a circumferential direction. The fixing plate 43 leads the host-side connecting wire 23, which is electrically connected to the cord 19, out of the reel 21.

Figure 6:
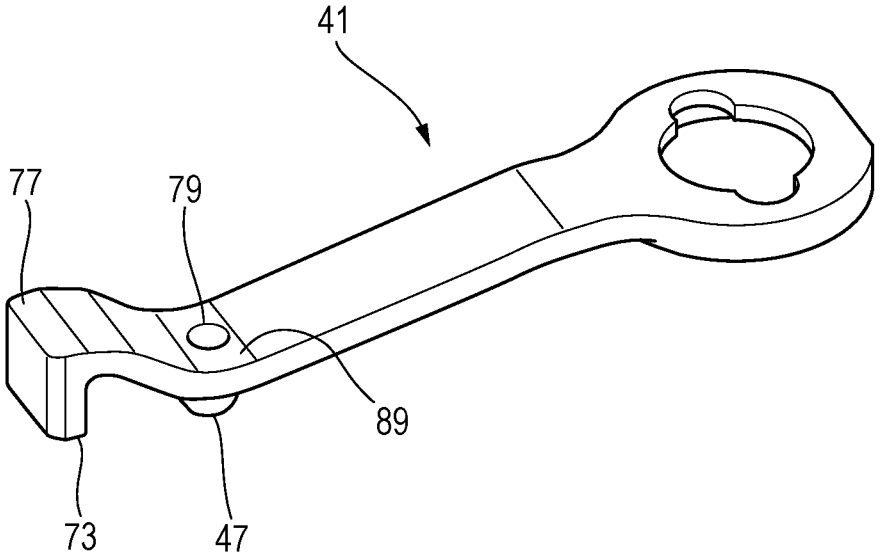
FIG. 6 is a perspective view of a sensor member shown in FIG. 3.

A first protrusion 47 is provided on a surface of an intermediate portion in the longitudinal direction of the sensor member 41, and the surface faces the circular plate 37 (with reference to FIG. 6). The first protrusion 47 is formed in a cylindrical shape whose central axis is in the same direction as the rotation center of the reel 21. In the sensor member 41, the first protrusion 47 formed of another component, for example, a sintered material having high wear resistance may be fixed by a screw. The first protrusion 47 is inserted into the guide groove 39 of the circular plate 37 and slides along the guide groove 39 as the reel 21 rotates. Since the sensor member 41, in which the first protrusion 47 is inserted in the guide groove 39, is rotatably supported by the housing 13, the sensor member 41 swings in and out of the circular plate 37 as the reel 21 rotates.

Figure 4:
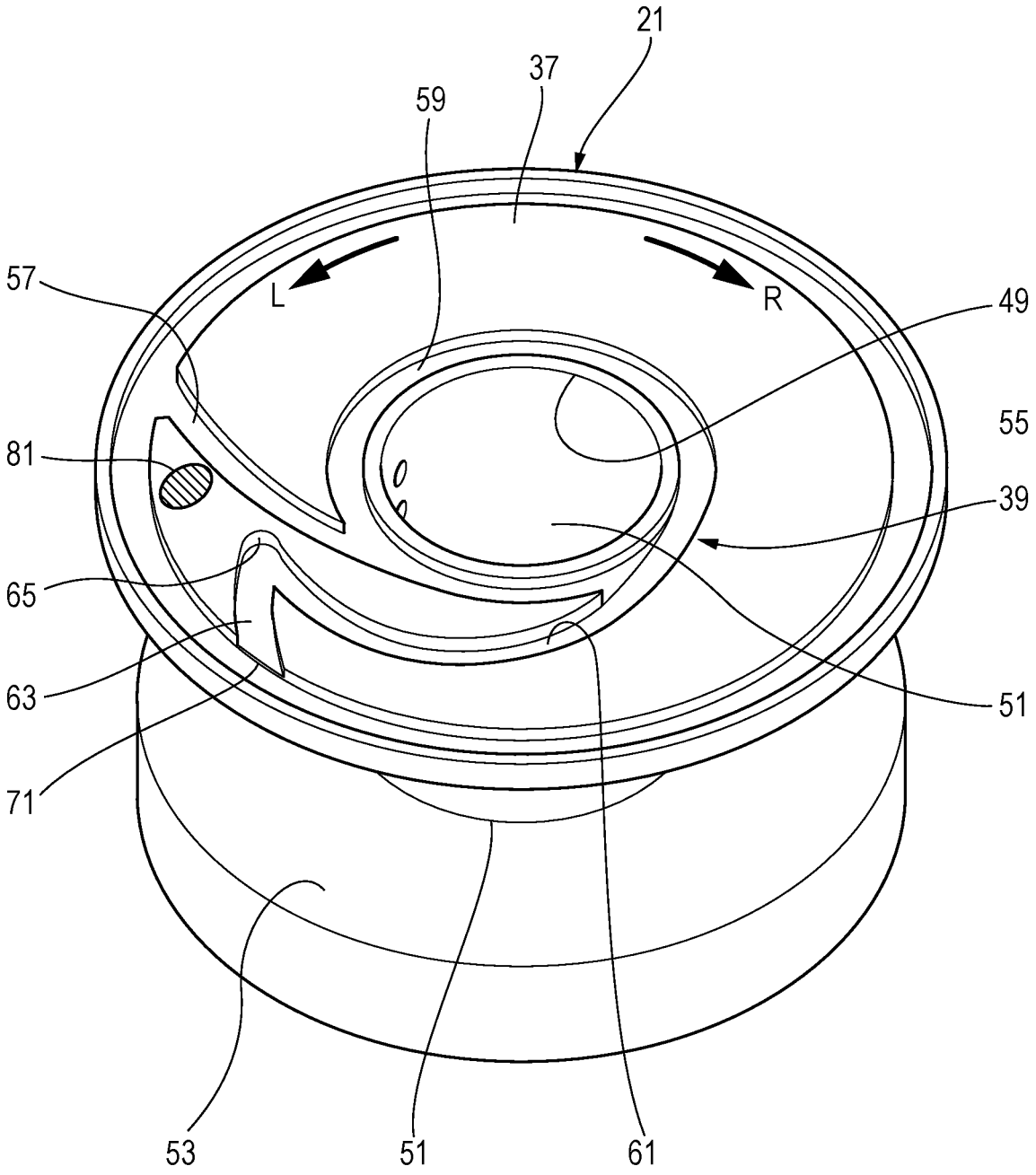
FIG. 4 is a perspective view of a reel shown in FIG. 3.

FIG. 4 is a perspective view of the reel 21 shown in FIG. 3. In the reel 21, a concentric shaft hole 49 is opened at a center of the circular plate 37. The shaft hole 49 leads to an inner periphery of a cylindrical shaft 51 fixed concentrically to the circular plate 37. The cylindrical shaft 51 is a core for winding the cord 19 around an outer periphery thereof. A lower flange 53 coaxial with the circular plate 37 is fixed to one end of the cylindrical shaft 51 in which the circular plate 37 fixed to the other end. Therefore, in the reel 21, the collapse of the cord 19 wound around the cylindrical shaft 51 is restricted by the circular plate 37 and the lower flange 53. In the reel 21, as shown in FIG. 3, the lower flange 53 is accommodated in the lower case 15.

The guide groove 39 includes an annular outer groove 55 dug along a periphery of the circular plate 37. The outer groove 55 is connected to an inner lead-in groove 57 which is inclined and extends inward in a radial direction of the circular plate 37. An end of the inner lead-in groove 57 is connected to an annular inner groove 59 formed by concentric circles having diameters smaller than that of the outer groove 55. The inner groove 59 is connected to a locking portion lead-in groove 61 which is inclined and extends outward in the radial direction. An end of the locking portion lead-in groove 61 is bent in a substantially V-shape or a V-shape so as to be connected to a locking portion outlet groove 63 and lead to the outer groove 55. A boundary between the locking portion lead-in groove 61 and the locking portion outlet groove 63 forms a locking portion 65 which is a substantially V-shaped or V-shaped valley bottom. In the locking portion 65, a tapering direction of the valley bottom which is formed to be a substantially V-shape or a V-shape is directed in a cord pull-out rotational direction (direction indicated by the arrow R) of the reel 21.

The reel 21 is biased to rotate in a rewinding direction of the cord 19 (direction indicated by the arrow L). Therefore, in the reel 21, the first protrusion 47 of the sensor member 41 is disposed at the locking portion 65 of the circular plate 37, and thus the rotation of the cord 19 in the rewinding direction (direction indicated by the arrow L) is restricted.

Figure 5:
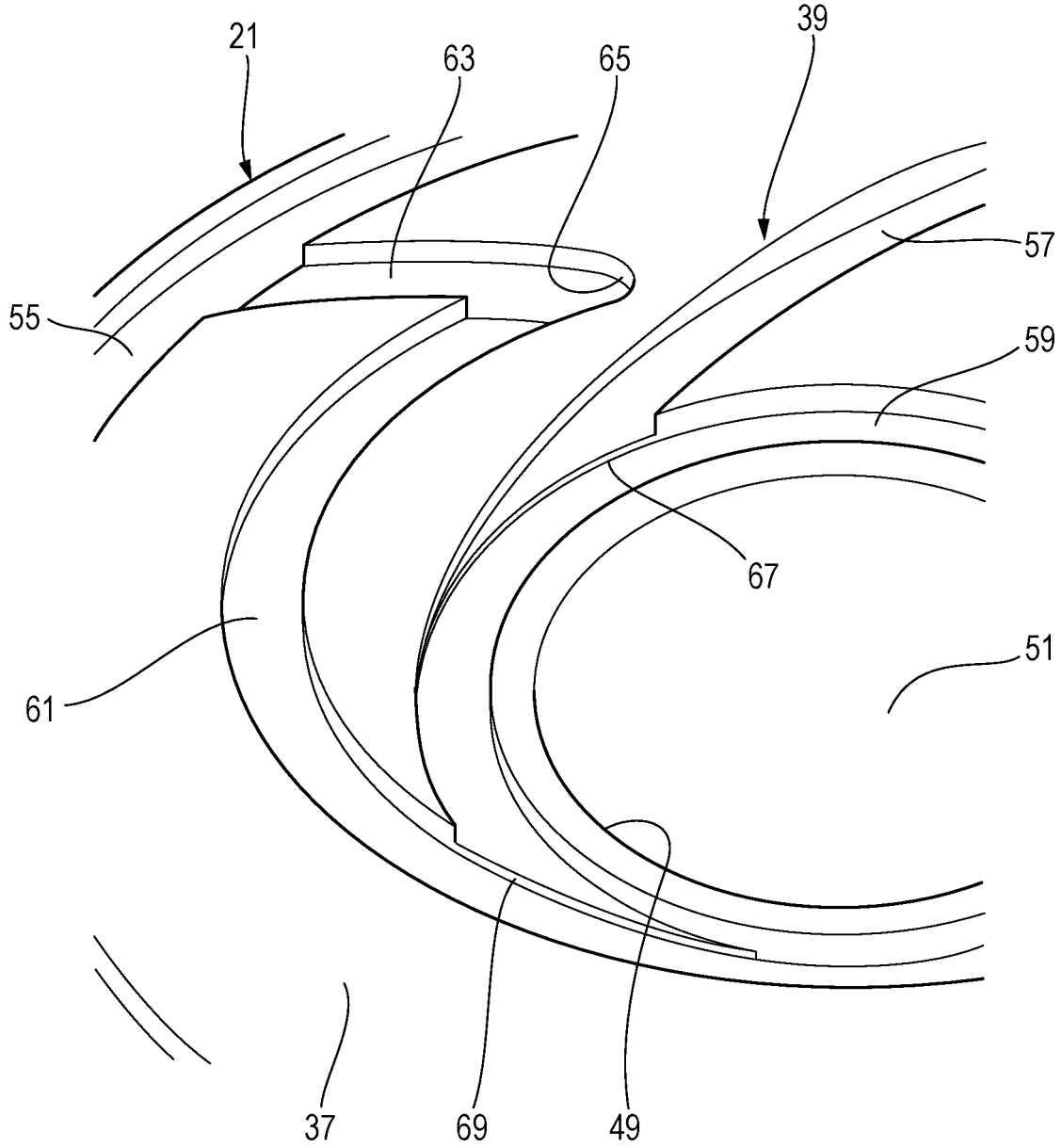
FIG. 5 is an enlarged view of an essential part of a guide groove shown in FIG. 4.

FIG. 5 is an enlarged view of an essential part of the guide groove 39 shown in FIG. 4. The guide groove 39 is provided with step portions at connection portions of each groove. Accordingly, the first protrusion 47 is restricted from returning from the inner groove 59 to the inner lead-in groove 57 by a step portion 67 shown in FIG. 5 so as to be smoothly lead to the locking portion lead-in groove 61 by a step portion 69 shown in FIG. 5, and is restricted from returning from the outer groove 55 to the locking portion outlet groove 63 by a step portion 71 shown in FIG. 4.

FIG. 6 is a perspective view of the sensor member 41 shown in FIG. 3. The base end of the sensor member 41 is supported by the housing 13 or the like swingably at a rotation center in a direction perpendicular to the circular plate 37. The tip end of the sensor member 41 is a free end. An intermediate portion in the longitudinal direction of the sensor member 41 is formed as a valley portion which is curved in a valley shape (in other words, a substantially V-shape or a V-shape) in a direction approaching the circular plate 37. The first protrusion 47 is provided on a lower surface of the intermediate portion of the sensor member 41, and the lower surface faces the circular plate 37.

Figure 7:
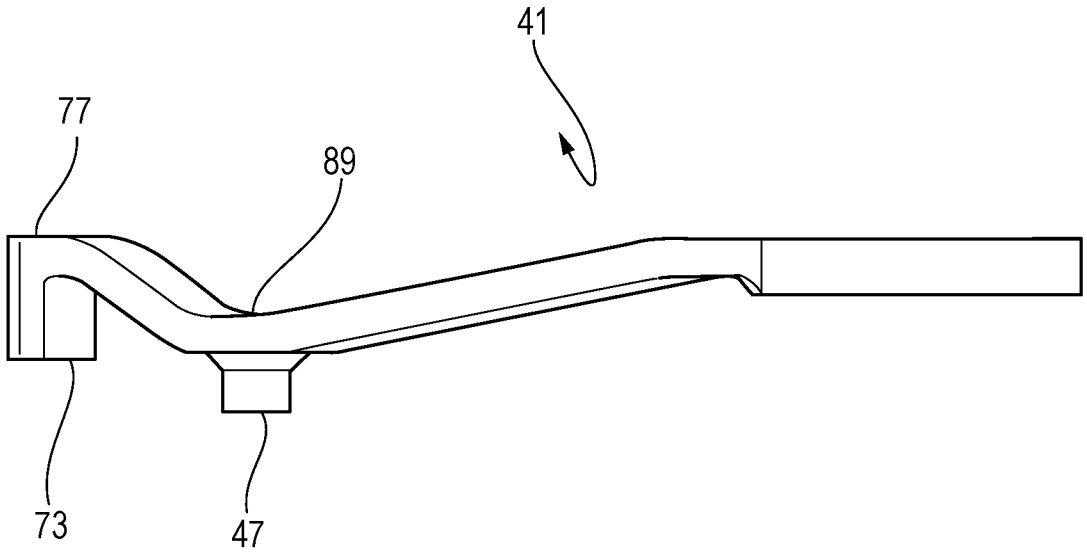
FIG. 7 is a perspective view of a side surface of the sensor member shown in FIG. 6 as viewed from a base end side.

FIG. 7 is a perspective view of a side surface of the sensor member 41 shown in FIG. 6 as viewed from the base end side. A second protrusion 73 is formed at the tip end of the sensor member 41. The second protrusion 73 is provided to be bent in a direction toward the circular plate 37 and on a lower surface of the tip end of the sensor member 41, and the lower surface faces the circular plate 37.

A top plate 75 (with reference to FIG. 8) is disposed opposite to the circular plate 37 with the sensor member 41 sandwiched therebetween. The top plate 75 can be formed as, for example, a part of the upper case 17. On the sensor member 41, a first pressing portion 77 is formed on an opposite side of the second protrusion 73. The first pressing portion 77 is disposed to approach and face the top plate 75.

The sensor member 41 is formed of, for example, resin material. On an upper surface of the sensor member 41 which is opposite to the first protrusion 47, a lightening portion 79 may be formed to suppress sink during molding. By providing the lightening portion 79 in the sensor member 41, relative positions of the first protrusion 47, the second protrusion 73, and the first pressing portion 77 can be formed with high accuracy.

In the code reel apparatus 11 according to the first embodiment, the guide groove 39 is not formed in a region on the circular plate with which the second protrusion 73 of the sensor member 41 is in contact. Here, the "region on the circular plate with which the second protrusion 73 is in contact" refers to a region of the circular plate 37 where the second protrusion 73 of the sensor member 41 faces when the first protrusion 47 of the sensor member 41 is disposed in the locking portion 65. Specifically, a region 81 is indicated by hatching in FIG. 4.

Figure 8:
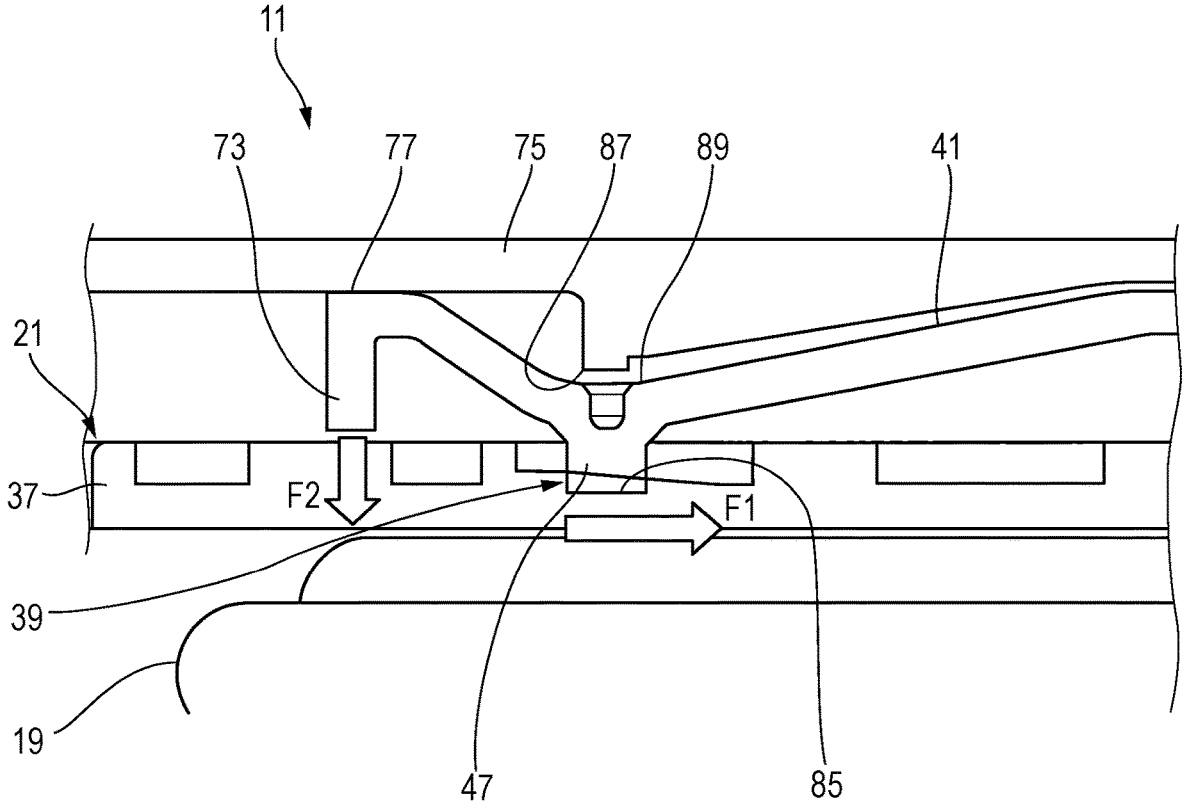
FIG. 8 is an operation view when a first protrusion rides on a side surface of the guide groove.

FIG. 8 is an operation view when the first protrusion 47 rides on a side surface of the guide groove 39. In the cord reel apparatus 11, the cord 19 may be pulled vigorously in a pull-out direction by the operation (that is, using method) of a user. In this case, the locking portion 65 of the guide groove 39 collides with the first protrusion 47. At this time, the first protrusion 47 may receive a reaction force F1 due to the collision from the locking portion 65 and may ride on the guide groove 39. The "ride" means that the first protrusion 47 moves in a direction away from a bottom surface 85 along a wall surface 83 of the guide groove 39, and does not mean that the first protrusion 47 is separated from the guide groove 39 and rides on a surface of the circular plate 37 in a sense of complementing that the second protrusion 73 is not in contact with the circular plate 37 at the timing when the first protrusion 47 rides on the surface of the circular plate 37.

A third protrusion 87 projecting in a direction toward the sensor member 41 is formed on the top plate 75. Meanwhile, a second pressing portion 89 disposed in a direction toward the top plate 75 is formed on the sensor member 41. The third protrusion 87 is formed to be in contact with the second pressing portion 89 when the first protrusion 47 rides on the wall surface 83 of the guide groove 39.

Next, the operation of the cord reel apparatus 11 will be described.

Figure 9:
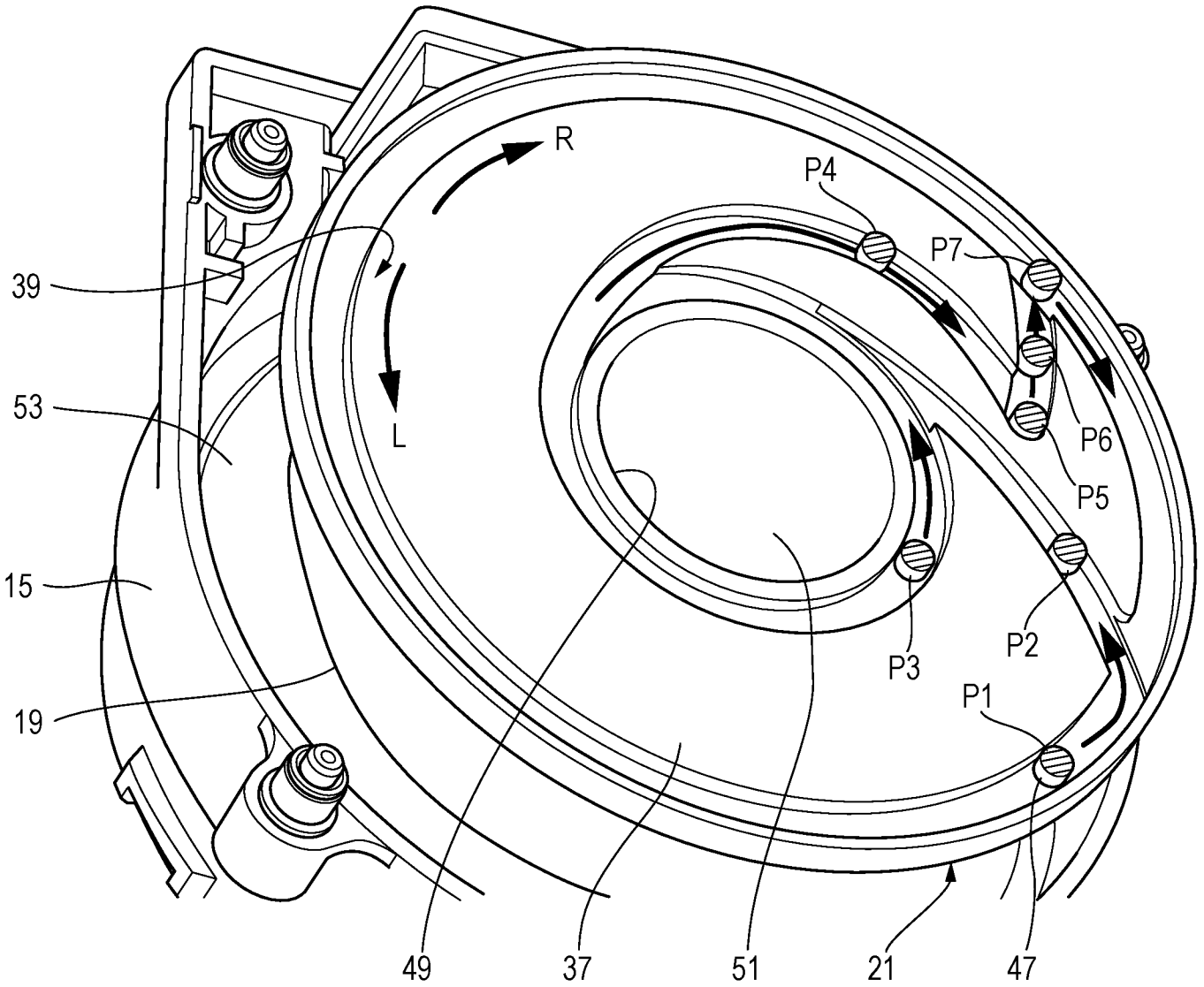
FIG. 9 is a view illustrating an operation in a moving process of the first protrusion.

FIG. 9 is a view illustrating the operation in a moving process of the first protrusion 47. In the cord reel apparatus 11, the first protrusion 47 of the sensor member 41 is disposed in the outer groove 55 as shown in FIG. 3 in a state where the cord 19 is rewound. When the user pulls out the cord 19, the reel 21 rotates in the pull-out direction (direction indicated by the arrow R) against a rotational biasing force of the spiral spring. When the circular plate 37 integrated with the reel 21 rotates in the direction indicated by the arrow R, the first protrusion 47 disposed in the outer groove 55 moves counterclockwise in FIG. 9 in relative to the outer groove 55.

Actually, the circular plate 37 rotates, and the first protrusion 47 reciprocally moves along an arc trajectory along with the swing of the sensor member 41. In the specification, in order to simplify the description, the operation of the guide groove 39 and the first protrusion will be described as a relative displacement of the first protrusion 47 with respect to the guide groove 39.

The first protrusion 47 at position P1 which moves counterclockwise in FIG. 9 in relative to the outer groove 55, leaves the outer groove 55 and proceeds to position P2 of the inner lead-in groove 57. Further, as the reel 21 rotates in the direction indicated by the arrow R, the first protrusion 47 of the sensor member 41 at position P3 continues to relatively move around the inner groove 59.

Figure 10:
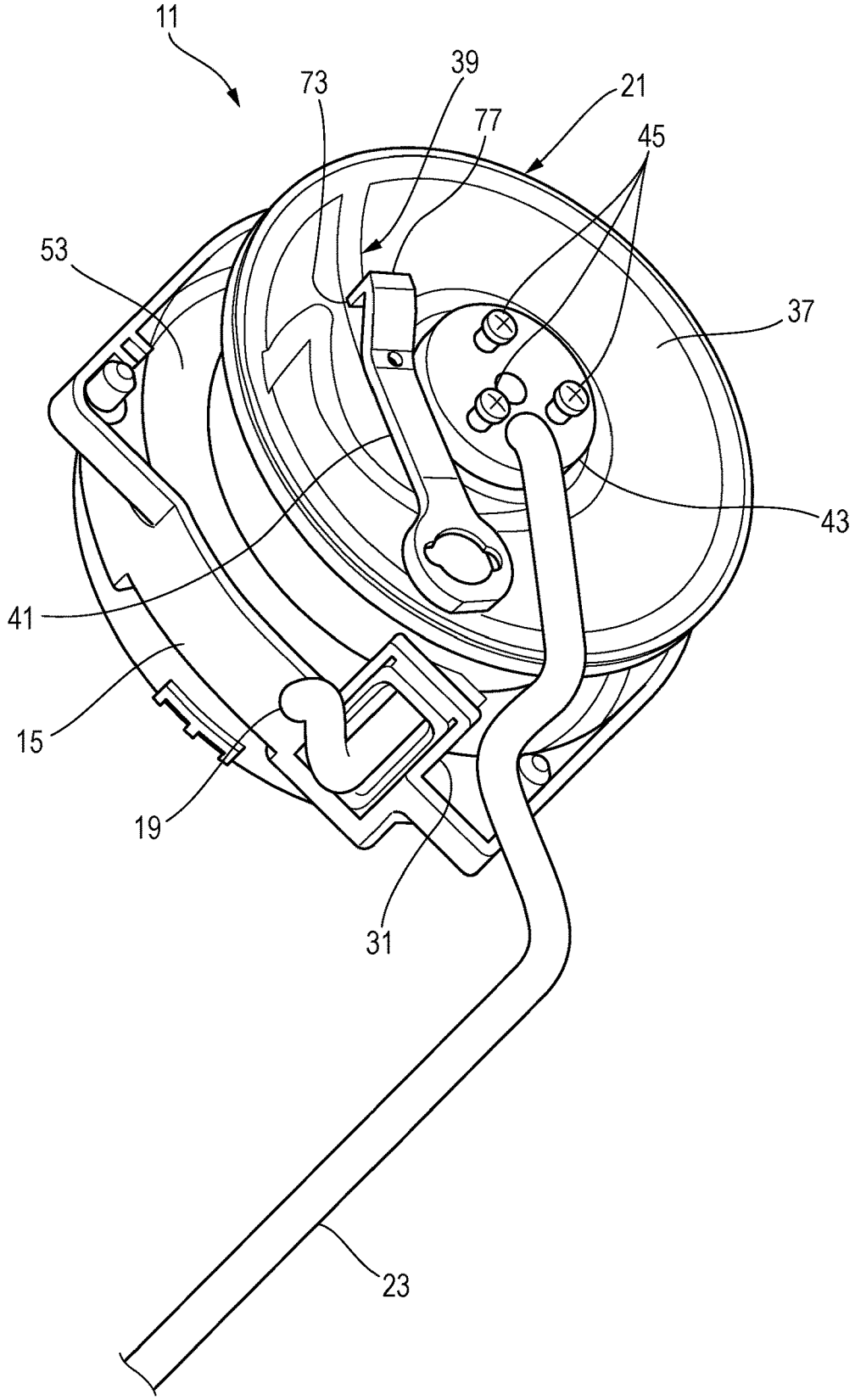
FIG. 10 is a perspective view showing the sensor member when a cord is pulled out.

FIG. 10 is a perspective view showing the sensor member 41 when the cord 19 is pulled out. The sensor member 41 swings to an innermost position of the circular plate 37 shown in FIG. 10 when the first protrusion 47 continues to move around the inner groove 59.

The user stops pulling when a pull-out length of the cord 19 reaches a desired length. At this time, a biasing force in the rewinding direction is accumulated in the reel 21. When the user feeds the cord 19 slightly in the rewinding direction, the reel 21 rotates in the direction indicated by the arrow L due to the rotational biasing force. Then, the first protrusion 47 located in the inner groove 59 moves clockwise in FIG. 9 in relative to the inner groove 59. The first protrusion 47 which moves clockwise in FIG. 9 in relative to the inner groove 59, leaves the inner groove 59 and proceeds to position P4 of the locking portion lead-in groove 61 (with reference to FIG. 4).

Figure 11:
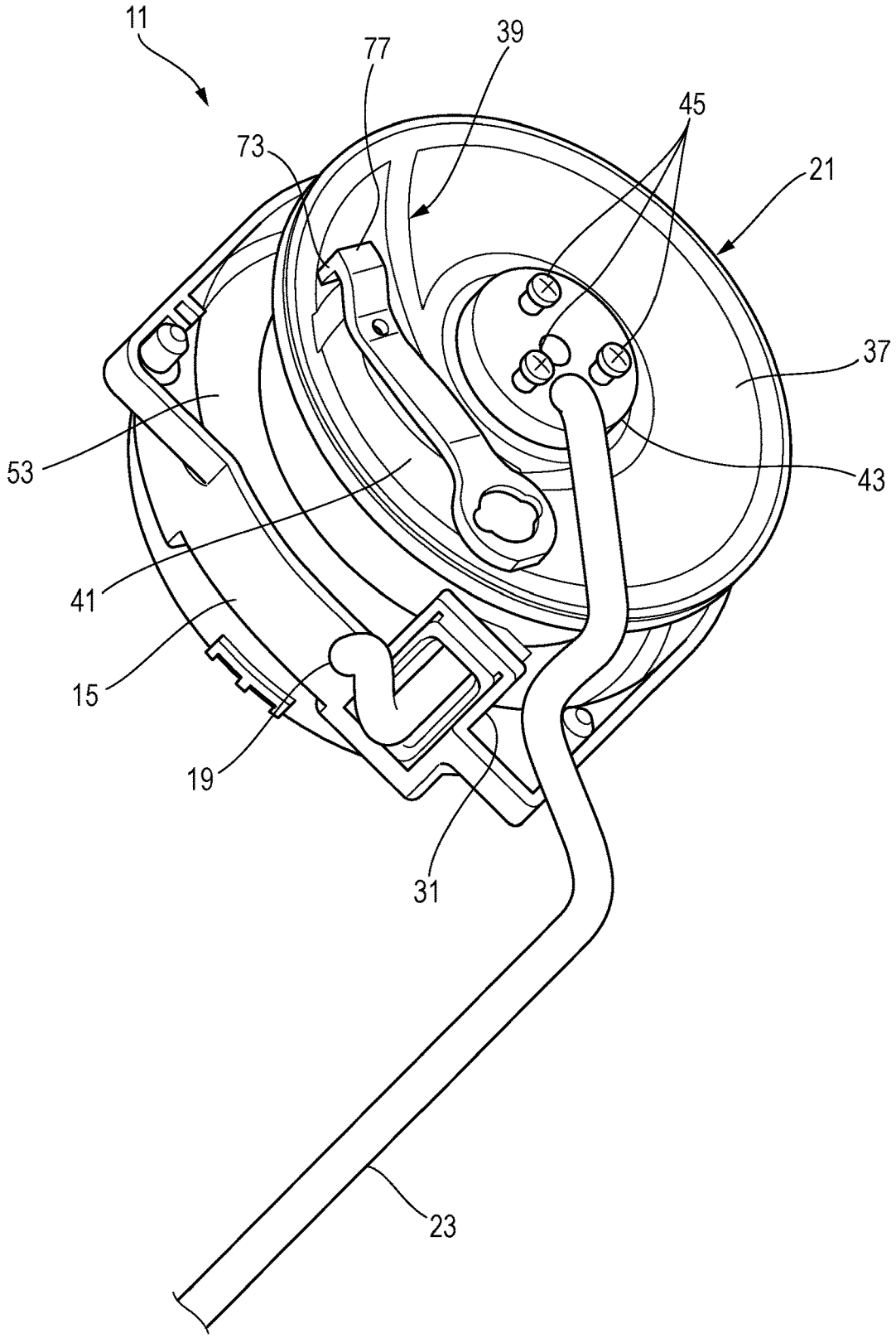
FIG. 11 is a perspective view showing the sensor member when a user stops pulling out the cord.

FIG. 11 is a perspective view showing the sensor member 41 when the user stops pulling out the cord 19. At this time, the sensor member 41 swings to a position shown in FIG. 11, which is an intermediate position between a swing position shown in FIG. 3 in which the first protrusion 47 is located in the outer groove 55 and a swing position shown in FIG. 10 in which the first protrusion 47 is located in the inner groove 59.

Further, as the reel 21 rotates in the direction indicated by the arrow L, the first protrusion 47 is locked to the locking portion 65 at position P5 (with reference to FIG. 9). The reel 21 is prevented from rewinding by locking the first protrusion 47 to the locking portion 65. Accordingly, the user can use the cord 19 pulled to a predetermined length.

When the use of the cord 19 is finished, the cord 19 is pulled out slightly by the user to rewind the cord 19. Then, the reel 21 rotates in the direction indicated by the arrow R, and the first protrusion 47 stopped at the locking portion 65 relatively moves to position P6 of the locking portion outlet groove 63. When the cord 19 is further pulled, the first protrusion 47 reaches position P7 of the outer groove 55. In this state, when the user further feeds the cord 19 in the rewinding direction, the reel 21 continues to rotate in the direction indicated by the arrow L due to the rotational biasing force, and the first protrusion 47 relatively moves clockwise in FIG. 9 to rewind all the cord 19.

Next, operation of the cord reel apparatus 11 according to the first embodiment will be described.

The cord reel apparatus 11 according to the first embodiment includes: the circular plate 37 which rotates in response to pulling out or rewinding of the cord 19, the guide groove 39 provided as a recess on the circular plate, the sensor member 41 including a first protrusion 47 which is slidable in the guide groove, the top plate 75 facing the circular plate 37 with the sensor member 41 sandwiched therebetween, the second protrusion 73 provided on the sensor member 41 and projecting in a direction toward the circular plate, and the first pressing portion 77 provided on the sensor member 41 and disposed in a direction toward the top plate. When the first protrusion 47 is closest to the bottom surface 85 of the guide groove 39, the second protrusion 73 is not in contact with the circular plate 37, and when the first protrusion 47 rides on the wall surface 83 of the guide groove 39, the first pressing portion 77 is in contact with the top plate 75, and thus the second protrusion 73 is in contact with the circular plate 37.

In the cord reel apparatus 11 according to the first embodiment, the reel 21 is rotatably accommodated in the housing 13 of the apparatus. The cord 19 is wound around the reel 21. The cord 19 is held in a state where the tip end on the pull-out side is out of the apparatus from the pull-out opening frame 31 provided in the housing 13. The reel 21 is biased in the direction to rewind the cord 19 by a biasing member such as a spiral spring. Therefore, by pulling out the cord 19 from the tip end side thereof on the pulling out side, the reel 21 rotates against the biasing force of the spiral spring, and a desired length can be pulled out within a range of the entire length. In the reel 21, when the cord 19 is pulled out, the biasing force is further accumulated in the spiral spring, and the rotational force in the direction of rewinding the cord 19 is accumulated.

In the reel 21, the circular plate 37 that rotates at the same rotation center as the reel 21 is formed as a part of the reel 21. The guide groove 39 is dug in the surface of the circular plate 37. The guide groove 39 serves as a groove cam (positive motion cam) that transmits motion to an inserted follower. The first protrusion 47 of the sensor member 41, which is a follower, is inserted in the guide groove 39 slidably along the guide groove 39. That is, the circular plate 37 and the sensor member 41 constitute a front cam.

On the circular plate 37, the top plate 75 is disposed to face the circular plate 37 and is opposite to the circular plate 37 with the sensor member 41 interposed therebetween. The top plate 75 is formed, for example, as a part of the housing 13.

The second protrusion 73 projecting toward the circular plate 37 is formed on the sensor member 41. The sensor member 41 is formed in an arm shape. The base end of the sensor member 41 is supported by the housing 13 or the like swingably at the rotation center in a direction perpendicular to the circular plate 37, and the tip end of the sensor member 41 is the free end. The second protrusion 73 projects toward the circular plate 37 at the tip end of the sensor member 41.

The first pressing portion 77 is formed on the sensor member 41 in a direction toward the top plate 75 which is opposite to the circular plate 37. In the sensor member 41, the second protrusion 73 is on a circular plate side of the first pressing portion 77. That is, the first pressing portion 77 and the second protrusion 73 are disposed on front and back sides of the tip end of the sensor member 41. The first pressing portion 77 is disposed to face the top plate 75 at a position close to the top plate 75.

Figure 12:
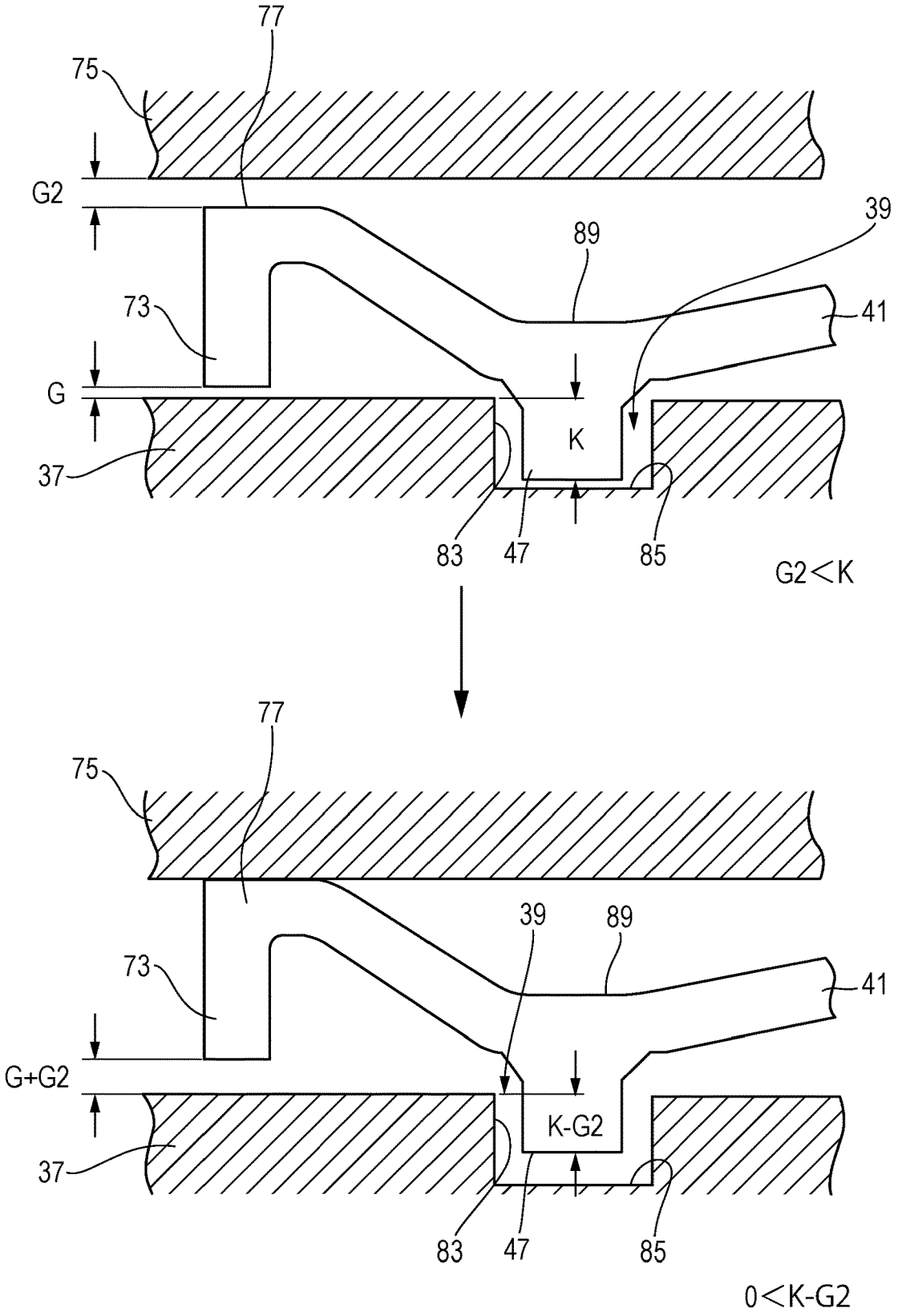
FIG. 12 shows side cross-sectional views of an essential part before and after the sensor member rides on the side surface of the guide groove.

FIG. 12 shows side cross-sectional views of an essential part before and after the sensor member 41 rides on the side surface of the guide groove 39. When the first protrusion 47 of the sensor member 41 is closest to the bottom surface 85 of the guide groove 39, the second protrusion 73 is separated from the circular plate 37 with a gap G and is not in contact with the circular plate 37. Therefore, the second protrusion 73 does not affect the rotation of the circular plate 37 at normal times. Further, the first protrusion 47 is hooked on the guide groove 39 with a margin K (that is, a length in the width direction where the first protrusion 47 and the wall surface 83 overlap. The same applies to the following). The hook margin K and a gap G2 are set to satisfy a relationship of K>G2. The gap G2 may have a positive value as shown in FIG. 12, or may be zero (0) when the first pressing portion 77 is in contact with the top plate 75.

When the sensor member 41 is lifted from the circular plate 37 and the first pressing portion 77 is in contact with the top plate 75, a distance between the circular plate 37 and the second protrusion 73 is a gap (G+G2). The first protrusion 47 lifted from the bottom surface 85 of the guide groove 39 is hooked on the guide groove 39 with a margin (K−G2). That is, the hook margin satisfies a relationship K−G2>0.

In the cord reel apparatus 11, the sensor member 41 swings as the first protrusion 47 slides along the guide groove 39 by pulling out the cord 19. When the desired pull-out length is reached, the pulling out is stopped and the cord 19 is automatically rewound by the biasing force of the spiral spring. At this time, when the hand-held cord 19 is fed in the rewinding direction, the first protrusion 47 of the sensor member 41 is locked to the locking portion 65 of the guide groove 39, and the rewinding rotation of the circular plate 37 is stopped via the sensor member 41. Accordingly, the cord 19 can be used with the desired length pulled out.

At this time, the first protrusion 47 of the sensor member 41 is reliably locked to the locking portion 65 when the cord 19 is fed in the rewinding direction at a certain initial speed or less while the cord 19 is being pulled out.

Meanwhile, when the cord 19 is vigorously fed in the rewinding direction at a speed equal to or higher than the certain initial speed while the cord 19 is being pulled out, the first protrusion 47 of the sensor member 41 vigorously collides with the wall surface 83 of the locking portion 65 due to rotational energy in the rewinding direction accumulated in the spiral spring. As a result, the first protrusion 47 of the sensor member 41 may ride on the wall surface 83 of the guide groove 39.

Figure 13:
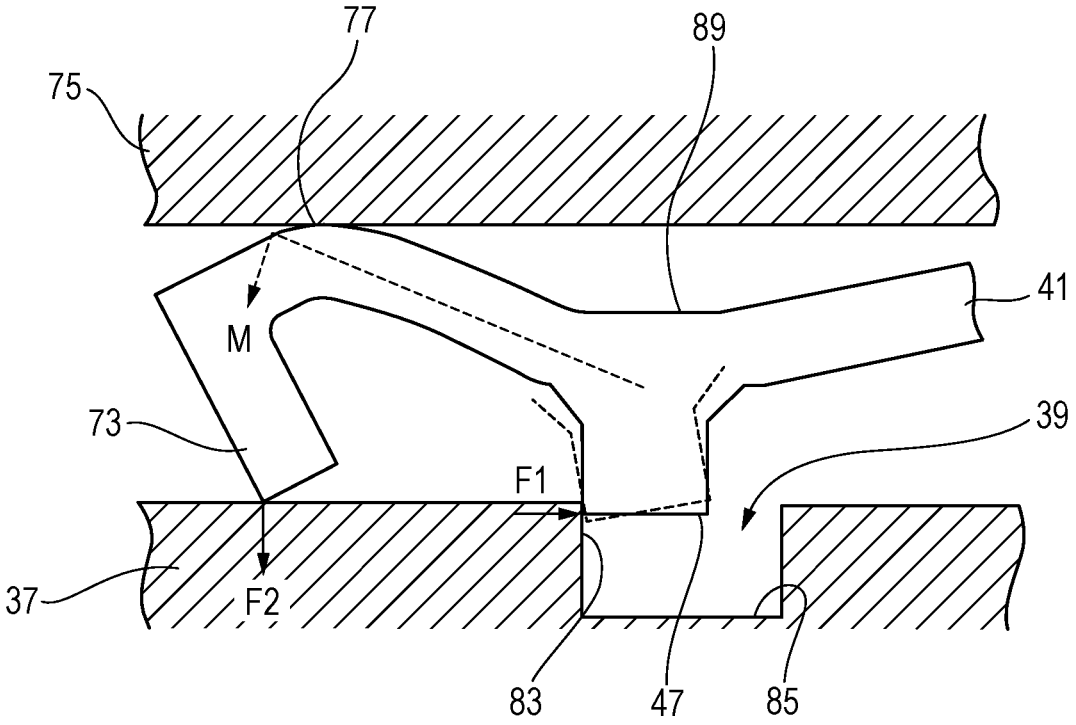
FIG. 13 is an operation view when a second protrusion is in contact with a circular plate.

FIG. 13 is an operation view when the second protrusion 73 is in contact with the circular plate 37. When the first protrusion 47 of the sensor member 41 rides on the wall surface 83 of the guide groove 39, the first pressing portion 77 is in contact with the top plate 75, and thus the second protrusion 73 is in contact with the circular plate 37. That is, in the sensor member 41, when the first protrusion 47 provided at a substantially central position in the longitudinal direction rides on the wall surface 83 of the guide groove 39, first, the first pressing portion 77 at the tip end is abutted with the top plate 75. When the sensor member 41 is displaced from this state in a direction in which the first protrusion 47 further rides on the guide groove 39, the first pressing portion 77 receives a reaction force in the pressing direction from the top plate 75. That is, the sensor member 41 is brought into a state where the tip end thereof is pressed by the top plate 75.

The sensor member 41 is elastically deformed in a direction in which the tip end approaches the circular plate 37 since the first pressing portion 77 receives the reaction force from the top plate 75. In the sensor member 41, the second protrusion 73 is in contact with the surface of the circular plate 37 due to the elastic deformation.

When the sensor member 41 vigorously collides with the wall surface 83 of the locking portion 65, the first protrusion 47 receives a reaction force F1 in a direction from the wall surface 83 toward the base end of the sensor member 41. As a result, a lower end of the first protrusion 47 is inclined in a direction toward the base end as shown by a broken line in FIG. 13. In the sensor member 41, when the first protrusion 47 projecting downward is pressed by the reaction force F1 in the direction toward the base end, a moment M in a direction of causing the tip end to approach the circular plate 37 is generated. The second protrusion 73 is also in contact with the surface of the circular plate 37 with a stronger force F2 due to the moment M.

In the sensor member 41, the second protrusion 73 is in strong contact with the circular plate 37 in this way, and thus the first protrusion 47 is prevented from being further deviated from the locking portion 65.

The second protrusion 73 is in contact with the circular plate 37, so that the sensor member 41 is prevented from being deformed such that the lower end of the first protrusion 47 is largely inclined in the direction toward the base end. The sensor member 41 is also less likely to be separated from the locking portion 65 due to the prevention of inclination.

As a result, in the cord reel apparatus 11, even in a case where the user pulls and releases the cord 19 violently and the first protrusion 47 rides on the wall surface 83 of the locking portion 65 so as to be lifted, the first protrusion 47 of the sensor member 41 can be prevented from being separated from the guide groove 39.

Further, since it is unnecessary to especially increase the strength of the sensor member 41 in the cord reel apparatus 11, the material cost does not increase. Since it is unnecessary to increase a thickness of the sensor member 41 or to form the sensor member 41 with a large size in order to increase the strength, the increase in product size can also be prevented. Further, the second protrusion 73 of the sensor member 41 is not in contact with the circular plate 37 during normal operation and the second protrusion 73 is in contact with the circular plate 37 only when the first protrusion 47 is lifted, so that the feeling of operation is not impaired during pulling out of the cord.

In the code reel apparatus 11, the guide groove 39 is not formed in the region 81 of the circular plate with which the second protrusion 73 of the sensor member 41 is in contact.

In the code reel apparatus 11, the guide groove 39 is not formed in the region 81 with which the second protrusion 73 of the sensor member 41 is in contact. The first protrusion 47 rides on the wall surface 83 of the guide groove 39, the first pressing portion 77 receives the reaction force in the pressing direction from the top plate 75, so that the second protrusion 73 is in contact with the surface of the circular plate 37. Then, since the guide groove 39 is not formed on the circular plate 37 in the region 81 with which the second protrusion 73 is in contact, the second protrusion 73 can be in strong contact with the circular plate 37. Accordingly, as described above, the first protrusion 47 is prevented from being further deviated from the locking portion 65. The deformation in which the lower end of the first protrusion 47 is inclined in the direction toward the base end is also prevented.

The top plate 75 has the third protrusion 87 projecting in the direction toward the sensor member, the sensor member 41 has the second pressing portion 89 disposed in the direction toward the top plate, and the third protrusion 87 is formed to be in contact with the second pressing portion 89 when the first protrusion 47 rides on the wall surface 83 of the guide groove 39.

In the cord reel apparatus 11, the sensor member 41 is formed in an arm shape. The base end of the sensor member 41 is supported by the housing 13 or the like swingably at the rotation center in a direction perpendicular to the circular plate 37, and the tip end of the sensor member 41 is the free end. An intermediate portion in the longitudinal direction of the sensor member 41 is formed as a valley portion which is curved in a valley shape (V-shape) in a direction approaching the circular plate 37. The first protrusion 47 is provided on the lower surface of the intermediate portion of the sensor member 41, and the lower surface faces the circular plate 37. The second protrusion 73 is provided on the lower surface of the tip end of the sensor member 41, and the lower surface faces the circular plate 37.

The top plate 75 is provided with the third protrusion 87 projecting in a direction toward the sensor member 41 at a position facing the valley portion. Meanwhile, the second pressing portion 89 is provided at the valley portion of the sensor member 41 and faces the third protrusion 87.

In the sensor member 41, when the first protrusion 47 rides on the wall surface 83 of the guide groove 39, the valley portion moves in a direction approaching the top plate 75. At this time, the second pressing portion 89 is in contact with the third protrusion 87 of the top plate 75, so that the sensor member 41 is restricted from being further lifted. The second pressing portion 89 of the valley portion is abutted with the third protrusion 87, so that the sensor member 41 is restricted in deformation in which the valley portion extends in a direction parallel to the top plate 75. As a result, the sensor member 41 is prevented from extending in parallel to the top plate 75, and the second protrusion 73 at the tip end is prevented from being separated from the circular plate 37 and being not in contact with the circular plate 37. Accordingly, in the cord reel apparatus 11, the second protrusion 73 is reliably in contact with the circular plate 37 when the first protrusion 47 of the sensor member 41 is lifted.

In the cord reel apparatus 11, the sensor member 41 is formed of resin material.

In the cord reel apparatus 11, the sensor member 41 is formed of resin material. The sensor member 41 is a resin molded product by injection molding or the like, so that a desired portion can be formed with a desired thickness, and the freedom of design can be increased. The sensor member 41 is a resin molded product, so that the material cost can be reduced compared to that of a sheet metal product. The mass productivity is improved. Further, the sensor member 41 can be lightweight for being a resin molded product.

Therefore, according to the cord reel apparatus 11 of the first embodiment, the increase in material cost and the increase in product size can be reduced, and the separation of the sensor member 41 can be restricted without impairing the feeling of operation.

Although various embodiments have been described above with reference to the drawings, it is needless to say that the present disclosure is not limited to such embodiments. It will be apparent to those skilled in the art that various changes, modifications, replacement, addition, deletion, equalization can be conceived within the scope of the claims, and it should be understood that those belong to the technical scope of the present disclosure. Each component in various embodiments mentioned above may be combined arbitrarily in the range without deviating from the spirit of the disclosure.

What is claimed is:

1. A cord reel apparatus, comprising:

a circular plate configured to rotate in response to pulling out or rewinding of a cord;

a guide groove provided as a recess on the circular plate;

a sensor member having a first protrusion which is slidable in the guide groove;

a top plate facing the circular plate with the sensor member sandwiched therebetween;

a second protrusion provided on the sensor member and projecting in a direction toward the circular plate; and a first pressing portion provided on the sensor member and disposed in a direction toward the top plate, wherein when the first protrusion is closest to a bottom surface of the guide groove, the second protrusion is not in contact with the circular plate; and wherein when the first protrusion rides on a wall surface of the guide groove, the first pressing portion is in contact with the top plate, so that the second protrusion is in contact with the circular plate.

2. The cord reel apparatus according to claim 1, wherein the guide groove is not formed in a region on the circular plate with which the second protrusion of the sensor member is in contact.

3. The cord reel apparatus according to claim 1, wherein the top plate has a third protrusion projecting in a direction toward the sensor member; and wherein the sensor member has a second pressing portion disposed in a direction toward the top plate, and when the first protrusion rides on the wall surface of the guide groove, the third protrusion is in contact with the second pressing portion.

4. The cord reel apparatus according to claim 1, wherein the sensor member is formed of resin material.

* * * * *